US008764589B1

(12) United States Patent
Thompson

(10) Patent No.: US 8,764,589 B1
(45) Date of Patent: Jul. 1, 2014

(54) EXTENDED FLIGHT SYSTEM FOR AN ARROW

(76) Inventor: Robin E. Thompson, Nephi, UT (US)

( * ) Notice: Subject to any disclaimer, the term of this patent is extended or adjusted under 35 U.S.C. 154(b) by 0 days.

(21) Appl. No.: 13/541,959

(22) Filed: Jul. 5, 2012

(51) Int. Cl.
*F42B 6/04* (2006.01)

(52) U.S. Cl.
USPC ..... 473/578; 473/585

(58) Field of Classification Search
USPC ..... 473/578, 582, 583, 585, 586
See application file for complete search history.

(56) References Cited

U.S. PATENT DOCUMENTS

| | | | | |
|---|---|---|---|---|
| D172,821 | S | 8/1954 | Cass | |
| 2,976,043 | A * | 3/1961 | Meyer | 473/586 |
| 3,815,916 | A * | 6/1974 | Meszaros | 473/586 |
| 4,234,192 | A | 11/1980 | Salamone | |
| 4,565,377 | A | 1/1986 | Troncoso, Jr. et al. | |
| 5,846,147 | A | 12/1998 | Basik | |
| 6,558,280 | B1 | 5/2003 | Kuhn | |
| 6,695,727 | B1 | 2/2004 | Kuhn | |
| 7,455,605 | B2 | 11/2008 | Rangel | |
| 8,500,579 | B1 * | 8/2013 | Long et al. | 473/578 |
| 2009/0163308 | A1 | 6/2009 | Odabachian et al. | |
| 2011/0172040 | A1 | 7/2011 | Belcik | |

* cited by examiner

*Primary Examiner* — John Ricci

(57) ABSTRACT

An extended flight system for extending the flying distance and improving the accuracy of an arrow when shot from a bow has a shaft first end having a threaded cavity for attaching a standard arrowhead. The shaft second end has a threaded rod for attaching a standard arrow shaft. The system has fletching located on the shaft exterior surface with fins or vanes resembling a shape of a triangle. The fins or vanes are located at an even distance from each other. A fin first end originates close to the shaft middle and a fin second end terminates close to the shaft second end. The arrowhead is attached to the shaft first end. The arrow shaft is attached to the shaft second end. A length of an arrow is extended upon installation of the system an equivalent of about the shaft length.

5 Claims, 4 Drawing Sheets

EXTENDED FLIGHT SYSTEM FOR AN ARROW

BACKGROUND OF THE INVENTION

Arrows are generally classified as shafted projectiles that are shot with a bow and have been found to be common in most cultures even predating recorded history. Arrows typically consist of a shaft, a head and fletching and may range in size from about eighteen inches to about sixty inches or greater. The present invention features an extended flight system for extending the flying distance and improving the accuracy of an arrow when shot from a bow.

SUMMARY

The present invention features an extended flight system for extending the flying distance and improving the accuracy of an arrow when shot from a bow.

In some embodiments, the system comprises a generally cylindrical linear shaft. In some embodiments, a shaft first end comprises a threaded cavity for attaching a standard arrowhead. In some embodiments, a shaft second end comprises a threaded rod for attaching a standard arrow shaft.

In some embodiments, the system comprises fletching located on the shaft exterior surface. In some embodiments, the fletching comprises a plurality of fins or vanes, each generally comprising a shape of a triangle. In some embodiments, the fins or vanes are around a radius of the shaft at an even distance from each other. In some embodiments, a fin first end originates close to the shaft middle and a fin second end terminates close to the shaft second end. In some embodiments, the width of the fin increases from the shaft middle to the shaft second end. In some embodiments, the width of the fin increases from the fin first end to the fin second end.

In some embodiments, an arrowhead is attached to the shaft first end. In some embodiments, an arrow shaft is attached to the shaft second end. In some embodiments, a length of an arrow is extended upon installation of the system an equivalent of about the shaft length.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Following is a list of elements corresponding to a particular element referred to herein:

100 Extended flight system
110 Arrowhead

Figure 1:
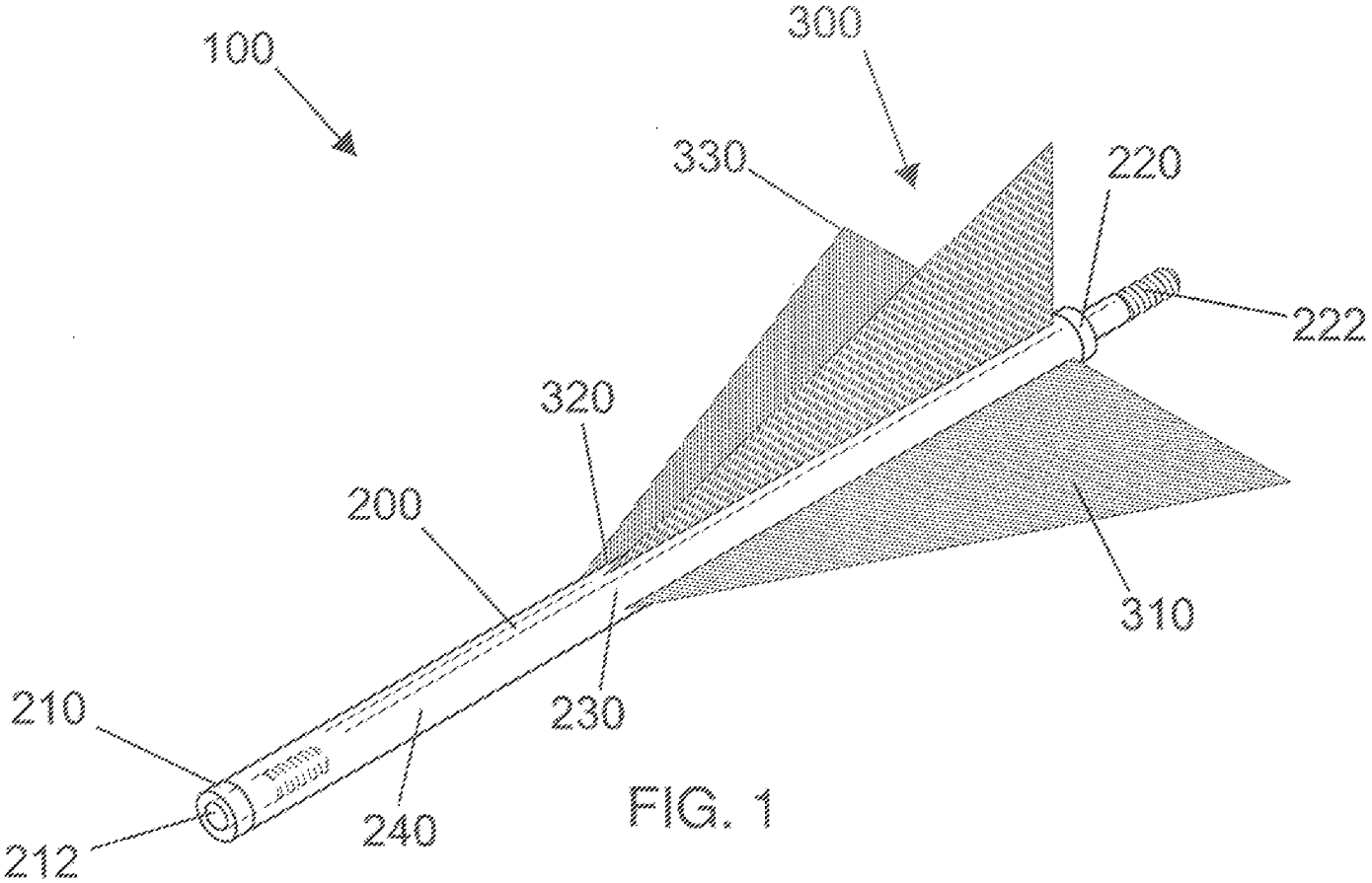
FIG. 1 is a perspective view of the present invention.
Figure 2:
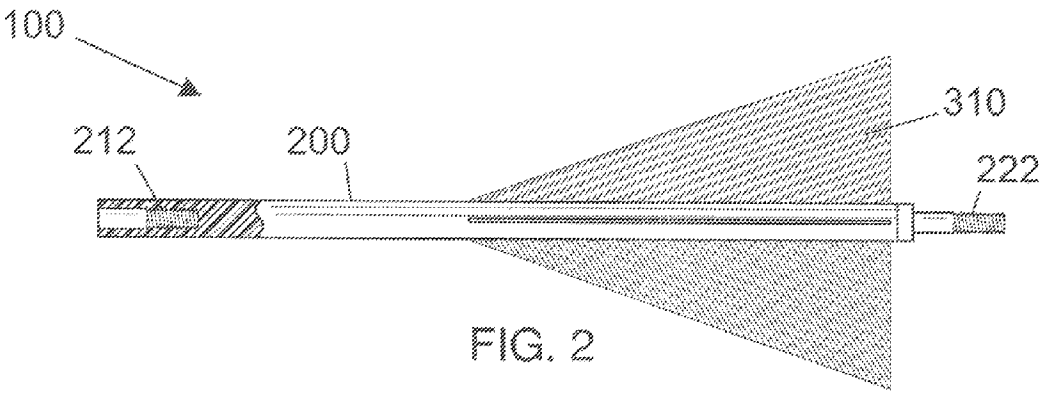
FIG. 2 is a side view of the present invention.
Figure 3:
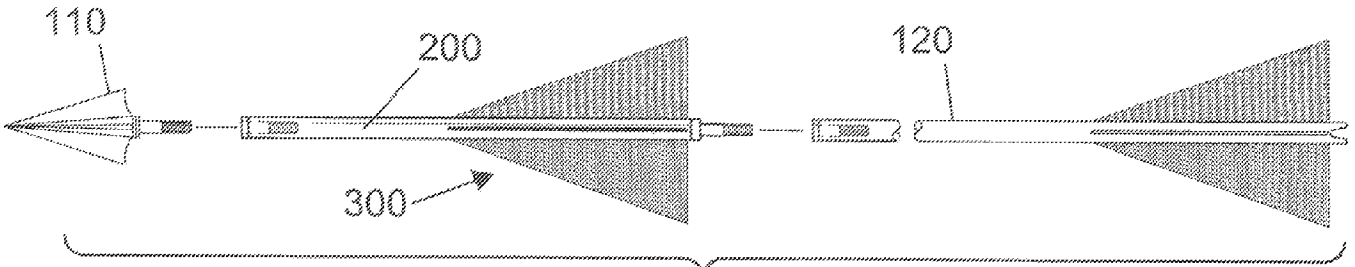
FIG. 3 is a side view of the present invention.
Figure 4:
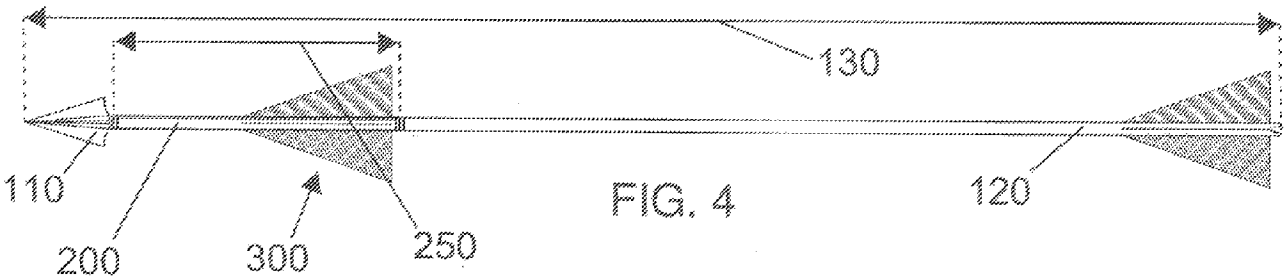
FIG. 4 is a side view of the present invention.
Figure 5:
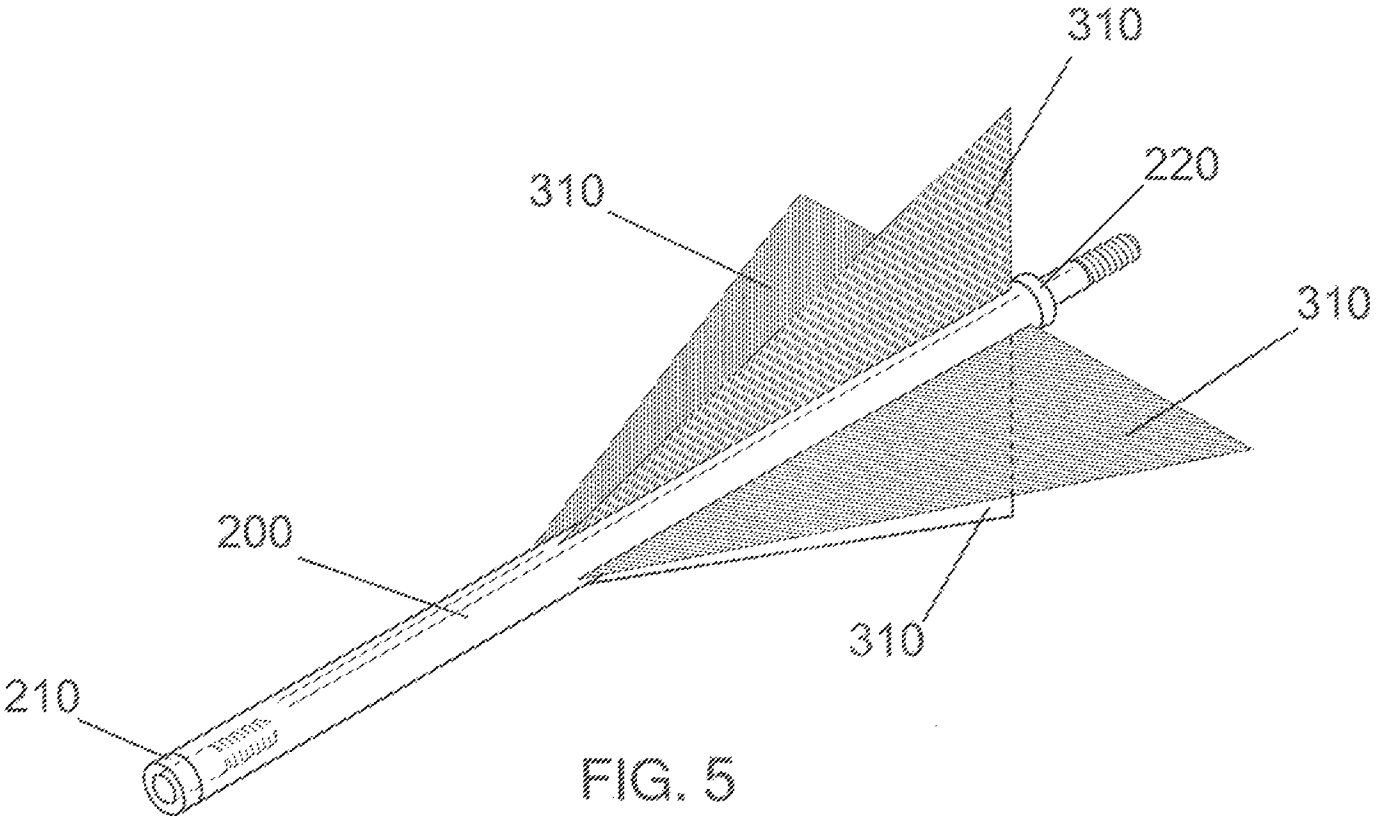
FIG. 5 is a perspective view of an alternate embodiment of the present invention.
Figure 6:
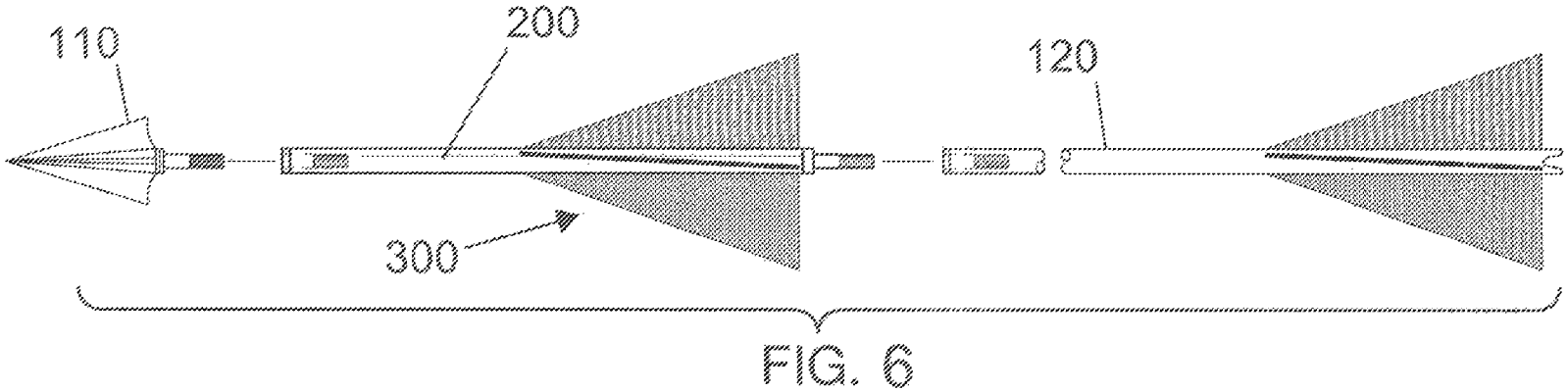
FIG. 6 is a side view of an alternate embodiment of the present invention.

120 Arrow shaft
130 Arrow length
200 Shaft
210 Shaft first end
212 Threaded cavity
220 Shaft second end
222 Threaded rod
230 Shaft middle
240 Shaft exterior surface
250 Shaft length
300 Fletching
310 Fins (or vanes)
320 Fin first end
330 Fin second end Referring now to FIG. 1-6, the present invention features an extended flight system (100) for extending the flying distance and improving the accuracy of an arrow when shot from a bow. In some embodiments, the system (100) comprises a generally cylindrical linear shaft (200) having a shaft first end (210), a shaft second end (220), a shaft middle (230), a shaft exterior surface (240), and a shaft length (250). In some embodiments, the shaft first end (210) comprises a threaded cavity (212) located therein for attaching a standard arrowhead (110). In some embodiments, the shaft second end (220) comprises a threaded rod (222) located thereon for attaching a standard arrow shaft (120).

In some embodiments, the system (100) comprises fletching (300) located on the shaft exterior surface (240). In some embodiments, the fletching (300) comprises a plurality of fins (or vanes) (310), each generally comprising a shape of a triangle. In some embodiments, the fletching (300) comprises a generally rounded, elliptical shape resembling a bird feather. In some embodiments, the fins (or vanes) (310) are located incrementally on a radius an even distance from each other, wherein a fin first end (320) originates close to the shaft middle (230) and a fin second end (330) terminates close to the shaft second end (220). In some embodiments, the width of the fin increases from the shaft middle (230) to the shaft second end (220). In some embodiments, the width of the fin increases from the fin first end (320) to the fin second end (330). In some embodiments, the width of the fin second end (330) is greater than the width first end.

In some embodiments, the arrowhead (110) is attached to the shaft first end (210). In some embodiments, the arrow shaft (120) is attached to the shaft second end (220). In some embodiments, an arrow length (130) is extended upon installation of the system an equivalent of about the shaft length (250).

In some embodiments, the fletching (300) comprises three fins (or vanes) (310). In some embodiments, the fletching (300) with three fins (or vanes) (310) is located 120 degrees apart. In some embodiments, the fletching (300) comprises four fins (or vanes) (310). In some embodiments, the fletching (300) with four fins (or vanes) (310) is located 90 degrees apart. In some embodiments, the fletching (300) is helically located on shaft exterior surface (240).

In some embodiments, the shaft length (250) is specified to affect the performance of the system (100). In some embodiments, the system (100) uses different shaft lengths (250) for different desired ranges. In some embodiments, the shaft length (250) is interchangeable.

In some embodiments, the shaft length (250) is about 1 to 2 inches. In some embodiments, the shaft length (250) is about 2 to 4 inches. In some embodiments, the shaft length (250) is about 4 to 6 inches. In some embodiments, the shaft length (250) is about 6 to 8 inches. In some embodiments, the shaft length (250) is greater than about 8 inches.

In some embodiments, the shaft (200) is balanced. In some embodiments, the shaft (200) diameter is greater than the arrow shaft (120) diameter. In some embodiments, the shaft (200) diameter is less than the arrow shaft (120) diameter.

As used herein, the term "about" refers to plus or minus 10% of the referenced number. For example, an embodiment wherein the shaft is about 10 inches in length includes a shaft that is between 9 and 11 inches in length.

The disclosures of the following U.S. Patents are incorporated in their entirety by reference herein: U.S. Pat. No. D 172,821; U.S. Pat. Pub. No. 2011/0172040 A1; U.S. Pat. Pub. No. 2009/0163308; U.S. Pat. No. 7,455,605; U.S. Pat. No. 6,695,727; U.S. Pat. No. 6,558,280; U.S. Pat. No. 5,846,147; U.S. Pat. No. 4,565,377; U.S. Pat. No. 4,234,192.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An extended flight system (100) for extending the flying distance and improving the accuracy of an arrow when shot from a bow, wherein said system (100) comprises:

(a) a generally cylindrical linear shaft (200) having a shaft first end (210), a shaft second end (220), a shaft middle (230), a shaft exterior surface (240), and a shaft length (250), wherein the shaft first end (210) comprises a threaded cavity (212) disposed therein for attachably engaging a standard arrowhead (110), wherein the shaft second end (220) comprises a threaded rod (222) disposed thereon for attachably engaging a standard arrow shaft (120);

(b) fletching (300) disposed on the shaft exterior surface (240), wherein the fletching (300) comprises a plurality of fins (or vanes) (310), each comprising a shape of a triangle, wherein the fins (or vanes) (310) are radially disposed at an even distance from each other, wherein a fin first end (320) originates proximal to the shaft middle (230) and a fin second end (330) terminates proximal to the shaft second end (220), wherein the width of the fin increases from the shaft middle (230) to the shaft second end (220), wherein the width of the fin increases from the fin first end (320) to the fin second end (330), wherein the width of the fin second end (330) is greater than the width of the fin first end (320); and (c) the arrow shaft (120) having fletching disposed thereon; wherein the arrowhead (110) is attached to the shaft first end (210), wherein the arrow shaft (120) is attached to the shaft second end (220), wherein an arrow length (130) is extended upon installation of the system an equivalent of about the shaft length (250), wherein there are a total of two shafts, in the system, the linear shaft (200), and the arrow shaft (120) each having fletching (300) disposed thereon.

2. The system (100) of claim 1, wherein the fletching (300) comprises three fins (or vanes) (310).

3. The system (100) of claim 1, wherein the fletching (300) comprises four fins (or vanes) (310).

4. The system (100) of claim 1, wherein the fletching (300) is helically disposed on shaft exterior surface (240).

5. An extended flight system (100) for extending the flying distance and improving the accuracy of an arrow when shot from a bow, wherein said system (100) consists of:

(a) a generally cylindrical linear shaft (200) having a shaft first end (210), a shaft second end (220), a shaft middle (230), a shaft exterior surface (240), and a shaft length (250), wherein the shaft first end (210) consists of a threaded cavity (212) disposed therein for attachably engaging a standard arrowhead (110), wherein the shaft second end (220) consists of a threaded rod (222) disposed thereon for attachably engaging a standard arrow shaft (120);

(b) fletching (300) disposed on the shaft exterior surface (240), wherein the fletching (300) consists of a plurality of fins (or vanes) (310), each consisting of a shape of a triangle, wherein the fins (or vanes) (310) are radially disposed at an even distance from each other, wherein a fin first end (320) originates proximal to the shaft middle (230) and a fin second end (330) terminates proximal to the shaft second end (220), wherein the width of the fin increases from the shaft middle (230) to the shaft second end (220), wherein the width of the fin increases from the fin first end (320) to the fin second end (330), wherein the width of the fin second end (330) is greater than the width of the fin first end (320); and (c) the arrow shaft (120) having fletching disposed thereon; wherein the arrowhead (110) is attached to the shaft first end (210), wherein the arrow shaft (120) is attached to the shaft second end (220), wherein an arrow length (130) is extended upon installation of the system an equivalent of about the shaft length (250), wherein there are a total of two shafts, in the system, the linear shaft (200), and the arrow shaft (120) each having fletching (300) disposed thereon.

* * * * *